United States Patent [19]

Diamond

[11] Patent Number: 5,006,967

[45] Date of Patent: Apr. 9, 1991

[54] SELF-ILLUMINATING GLASS BLOCK CONSTRUCTION UNIT

[76] Inventor: Gary Diamond, 18220 Margate St., Tarzana, Calif. 91356

[21] Appl. No.: 355,411

[22] Filed: May 22, 1989

[51] Int. Cl.[5] ..... F21S 1/14

[52] U.S. Cl. ..... 362/147; 52/306; 362/153; 428/34.4

[58] Field of Search ..... 40/544, 902, 542; 362/311, 147, 153, 363, 801; 428/7, 34.4; 52/28, 306

[56] References Cited

U.S. PATENT DOCUMENTS

| | | | |
|---|---|---|---|
| 573,088 | 12/1896 | Hawkins | 40/544 |
| 1,145,837 | 7/1915 | Hoff | 362/363 |
| 2,106,177 | 1/1938 | Hultquist | 52/308 X |
| 2,740,957 | 4/1956 | Davies | 362/311 X |
| 3,721,050 | 3/1973 | Perina | 52/28 |
| 3,963,915 | 6/1976 | Spivey | 362/363 |
| 4,467,193 | 8/1984 | Carroll | 362/800 X |
| 4,601,924 | 7/1986 | Birkes et al. | 428/7 |
| 4,765,102 | 8/1988 | Kuchem | 52/28 |
| 4,774,793 | 10/1988 | Mayer | 52/306 X |

*Primary Examiner*—Henry F. Epstein

[57] ABSTRACT

An improved glass block construction unit having an electrical assembly (13) integrally attached through a glass wall (2) of the unit, thereby allowing the unit to be self illuminating.

5 Claims, 1 Drawing Sheet

SELF-ILLUMINATING GLASS BLOCK CONSTRUCTION UNIT

BACKGROUND—FIELD OF INVENTION

This invention relates to glass block construction units, specifically to such units which provide illumination.

BACKGROUND—DESCRIPTION OF PRIOR ART

Heretofore, glass block construction units, formed into wall panels were never self-illuminated, but instead allowed light to pass through the glass block unit from a source exterior to the glass block unit. Natural daylighting, or an electrical source of light entered through one side of the glass block unit and exited through the other remaining side. To provide interesting special effects, designers have called for neon lights, or other electric lighting devices to be installed independently behind a wall of glass block. These prior art uses of electric lighting required their own form of support, so that in essence, the glass block wall and the electric lighting were abutted adjacent to each other, often in a crowded installation, whereby it was difficult to service the electric lighting adjacent to the glass block wall. Also, the type of electric light chosen to illuminate the glass block wall, had its own inherent shape, for example, neon lights are usually provided in long narrow tubes of light, or flourescent tubes in a somewhat larger format, but also long narrow tubes, and so these shapes of lighting fixtures were visible through the glass block wall, creating hot spots thus betraying their hybrid nature, as separate from the glass block and therefore not coordinating aesthetically with the rectilinear, cellular nature of a glass block wall. Therefore in the prior art a long felt need to provide an aesthetic and efficient luminous wall has existed unfullfilled.

Also in the prior art, luminaires are known in which the glass lamp portion of the device is permanently fused to the electrical device portion of the luminaires, and must be wastefully thrown away when the electrical device is spent, although the glass lamp is still usable, which prevents reusing the glass lamp portion by replacing the filament or electrode, that is by replacing the electrical device only.

OBJECTS AND ADVANTAGES

Accordingly, several objects and advantages of my invention are;

(a) to provide a glass block construction unit which integrally provides for its own luminance, thus eliminating the bad aesthetic look of prior art "back lit" assemblies as mentioned above;

(b) to eliminate the need for the adjacency of two prior art devices not meant to be combined; glass block unit and electrical lighting, into an integral assembly, and thereby eliminate the inherent disadvantages of such an assembly of two devices which were never meant to be combined, thereby providing a more streamlined, appropriate, and utilitarian device, specially designed for its use;

(c) the device according to the present invention provides one single though more complex device where the prior art requires two separate devices. The device of the present invention simplifies building construction by creating a more complex building construction unit which simultaneously provides the advantages of both a wall and a lighting device, therefore providing a luminous wall;

(d) to provide a luminous construction unit whose light may be a variety of different colors;

(e) to provide a luminous construction unit whose color of light may be easily varied;

(f) to provide a luminous construction unit whose electrical assembly can be easily removed and replaced after it has burned out and completed its useful life span, thereby making permanent, and extending and increasing the life and usefulness of of the glass lamp portion the unit, which is a previously unappreciated advantage, and also thereby creating a permanent lighted wall assembly having a replaceable electrical joined to it, and creating the unexpected result of a permanent wall which may be lighted and renewed indefinitely.

(g) to provide a luminous construction unit which can be computer controlled to provide a specific pattern of lighted or not lighted glass block units, thereby forming aesthetic images, coherent picture images or alphanumeric or other data display;

(h) to provide a luminous construction unit having multiple chambers at the interior of the unit, thereby allowing for a plurality of different types of electric illumination within the same unit;

(i) to provide for many different kinds of electric illumination to be possible within the glass block unit, such as incandescent, tungsten-halogen, flourescent, neon, high pressure sodium, mercury vapor, metal halide or others;

(j) to provide for a new type of elctric lamp which is integral with a glass block wall, thereby forming a luminous wall;

(k) to provide an integrally illuminated glass block unit which may be formed in a size substantially smaller than glass block units of the prior art, which may be used to create a data screen for the formation of images and alphanumertics;

Still further objects and advantages will become apparent from a consideration of the ensuing description and drawings.

Reference Numerals

Figure 1:
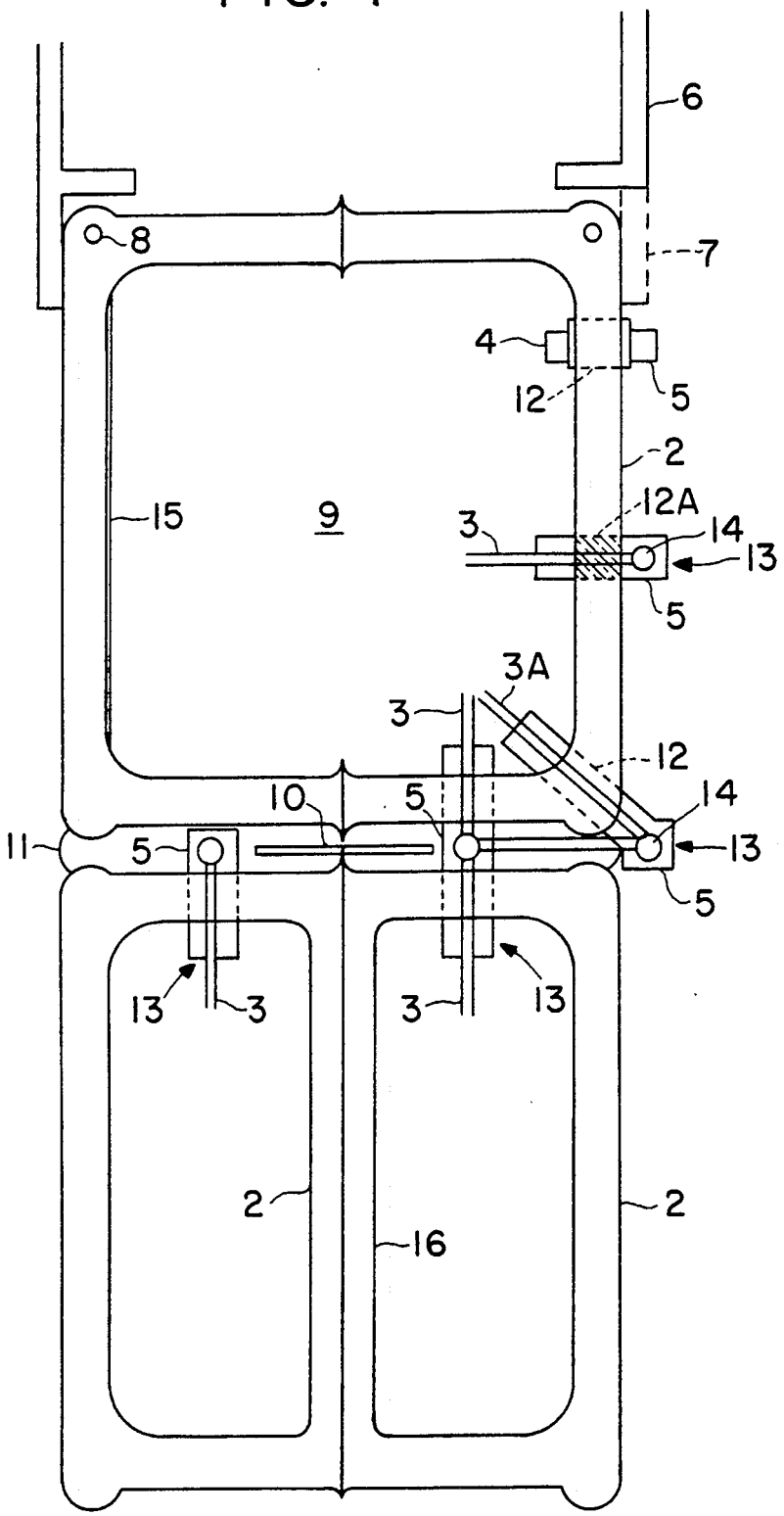
FIG. 1 is a cross sectional view through an assembly of glass block units.

2 glass block unit wall, lamp
3 electrical device, filament
**3*a*** electrical device, electrode
4 valve
5 base
6 frame
7 locking device
8 reinforcing
9 interior of glass block unit
10 horizontal reinforcing
11 mortar joint
12 base removable device
**12*a*** screw-in base removable device, threads in reverse direction from prior art
13 electrical light assembly
14 power supply device
15 chemical coating
16 interior cell wall

DESCRIPTION OF INVENTION

An embodiment of the device of the present invention is illustrated in FIG. 1 (cross section) showing features which may be used in different combinations to provide different types of illumination; for example incandescent or flourescent. A glass block construction unit wall 2 forming a lamp is penetrated by an electrical light assembly 13 which contains an electrical device being either a filament 3 or an electrode 3*a*. The glass block wall may also be penetrated by a valve 4 for the introduction of a gas. The electrical device 3,3*a* is mounted to a base 5. A frame 6, either horizontal or vertical is used to further rigidify an assembly of a plurality of glass blocks. An adjustable device 7 allows the removal of a single glass block from a framed-in assembly of several glass blocks. Reinforcing rods 8 may be located within a glass wall of a glass block unit. The interior of the glass block unit 9 may contain a gas. Horizontal reinforcing 10 may be located within the mortar joints 11. A removable device 12, having a threaded screw-in feature with the threads in the opposite direction to the screw-in feature of the bases of lamps of the prior art to make the base unit 5 holding the electrical device 3, 3*a* separable from the glass block wall is provided, thereby the entire electrical light assembly 13 may be removed utilizing the removable device 12 which interconnects the electrical device 3,3*a* to the base 5, and the entire assembly 13 to the glass block wall 2. Within the base an electrical power supply device 14 is provided. A chemical coating 15 may be applied to an inside wall of the glass block unit, as required for illumination.

OPERATION OF THE INVENTION

Electric current from a source passes through a power supply device 14 and contacts the base 5 of the electrical light assembly 13. The current passes through the base unit and into the electrical device 3, 3*a* which provides illumination. A removable device 12 is interconnected between the electrical device and the base thereby allowing for the removal of the entire electrical light assembly 13, when it is spent and replacement by a new assembly. This feature makes it possible to renew the device of the present invention without removing glass block lamp, which is impossible in the prior art wherein the lamp, the filament and the base are inseparable. This may be achieved by the threads of a screw-in type connector 12*a* in the base, being similar to the screw-in threads of bases of electrical lamp assemblies of the prior art, but with the direction of the threads reversed to allow the filament to be joined and united to the glass block forming the lamp of the device of the present invention. Using the non-reversed threads of a lamp base of the prior art, this combination of elements would be impossible to combine and to function. Another removable device 12 not screw-in threads may also be used to join the electrical assembly to the glass block lamp. The interior of the glass block may contain a gas or a vacuum and an interior surface of the glass block wall may contain a chemical coating 15 to aid in providing illumination. The glass blocks may be layed up in walls or panels by methods similar to the prior art with mortar joints 11 having horizontal reinforcement 10 located within them. The entire wall or panel assembly may be further stiffened by the location of reinforcing rods 8 within the wall of the glass block unit itself, and also by a horizontal or vertical framework 6 carrying the glass block wall or panel assembly. This framework may have an adjustable device 7 to allow for the removal of single glass blocks. Gas may be placed inside the air-tight glass block unit through use of a valve 4 penetrating the wall of the glass block, and may be replenished when it is spent. By having more than one airtight cell located within the same glass block 16, several different types of illumination may be provided within the same glass block unit.

SUMMARY, RAMIFICATIONS, AND SCOPE

Accordingly, the reader will see that the construction unit of this invention can be used to provide a glass block wall or panel which is self illuminating.

It can provide a lighted glass block wall or panel which may be provided in the several different colors allowed of neon, incandescent, flourescent, high pressure sodium, mercury vapor, metal halide, or other lighting devices.

It has an electrical lighting device penetrating a glass wall of a glass block unit.

It provides a luminous glass block wall which may have its electrical assembly removed when it is spent and replaced by a new electrical assembly.

It permits the construction of a more aesthetic and more efficient luminous wall than has heretofore been possible, since it eliminates the strange hybrid assemblies which have previously been formed with the abuttment of a traditional glass block wall and traditional lighting device providing a backlighting situation, which contained the problem of having visible "hot spots" where the lighting device were located, and by providing a device which is designed for its purpose, thereby having only one single assembly providing all of the features of a luminous wall.

It provides a valve through the glass block unit wall thereby allowing for the entry of a gas.

It allows for several different types of electric light to be provided within one single glass block unit, by forming independent cellular areas within one glass block unit.

Although the description above contains many specificities, these should not be construed as limiting the scope of the invention but as merely providing illustrations of some of the presently preferred embodiments of this invention. For example, the glass block units may be formed of other shapes having partially spherical surfaces, or the glass block units may be made much larger or much smaller in size than traditional glass block construction units, etc.

Thus the scope of the invention should be determined by the appended claims and their legal equivalents, rather than by the examples given.

What is claimed is:

1. A modular device formed of a hollow glass block construction unit used for forming walls and panels, the device comprising, a glass block construction unit assembly having all faces made of glass forming a chamber, an electric light means assembly integral with said glass block unit, said electric light means assembly penetrating through a wall of said glass block unit, said electric light means assembly being removable from said glass block unit, electrical conductors connected to said electric light means being located at the exterior of said glass block unit, said construction unit assembly thereby forming a self-illuminating glass block construction unit.

2. The device according to claim 1 in which a computer microcircuit means is used to turn the electrical light means on and off.

3. The device according to claim 1 in which a plurality of separate cells are contained within said glass block unit formed by glass partitions within said block allowing for the inclusion of a plurality of separate independent electrical light means assemblies within said block.

4. The device according to claim 1 in which a valve is located through a wall of said glass block.

5. The device according to claim 1 in which said glass block unit forms the only vacuum chamber in said device.

* * * * *